US006989361B2

(12) United States Patent
Gregory et al.

(10) Patent No.: US 6,989,361 B2
(45) **Date of Patent: *Jan. 24, 2006**

(54) SOLID FABRIC CONDITIONING COMPOSITIONS

(75) Inventors: Denis James Gregory, Merseyside (GB); Sarah Wylde, Merseyside (GB)

(73) Assignee: Unilever Home & Personal Care USA Division of Conopco, Inc., Greenwich, CT (US)

( * ) Notice: Subject to any disclaimer, the term of this patent is extended or adjusted under 35 U.S.C. 154(b) by 157 days.

This patent is subject to a terminal disclaimer.

(21) Appl. No.: 10/402,161

(22) Filed: Mar. 28, 2003

(65) Prior Publication Data

US 2003/0191041 A1 Oct. 9, 2003

(30) Foreign Application Priority Data

Mar. 28, 2002 (GB) ..... 0207484

(51) Int. Cl.
*C11D 1/62* (2006.01)
*C11D 17/06* (2006.01)

(52) U.S. Cl. ..... 510/452; 510/504

(58) Field of Classification Search ..... 510/452, 510/521, 504

See application file for complete search history.

(56) References Cited

U.S. PATENT DOCUMENTS

| | | | | |
|---|---|---|---|---|
| 4,427,558 | A | 1/1984 | David | |
| 4,510,073 | A | 4/1985 | Hara et al. | |
| 5,259,964 | A | 11/1993 | Chavez et al. | |
| 5,460,736 | A * | 10/1995 | Trinh et al. | 510/516 |
| 5,698,513 | A | 12/1997 | Schulz et al. | |
| 5,747,443 | A * | 5/1998 | Wahl et al. | 510/515 |
| 6,440,926 | B1 * | 8/2002 | Spadoni et al. | 510/445 |
| 6,521,589 | B2 * | 2/2003 | Demeyere et al. | 510/527 |

FOREIGN PATENT DOCUMENTS

| | | |
|---|---|---|
| EP | 0 107 479 | 5/1984 |
| EP | 0 267 999 | 5/1988 |
| EP | 0 111 074 | 4/1990 |
| EP | 0 234 082 | 8/1990 |
| EP | 0 568 297 | 11/1993 |
| EP | 0 739 976 | 10/1996 |
| EP | 0 753 571 | 1/1997 |
| EP | 0 881 279 | 12/1998 |
| JP | 62 057639 | 3/1987 |
| JP | 02 182972 | 7/1990 |
| JP | 06 228875 | 8/1994 |
| JP | 06 306769 | 11/1994 |
| WO | 92/18593 | 10/1992 |
| WO | 94/07978 | 4/1994 |
| WO | 99/60081 | 11/1999 |
| WO | 00/60039 | 12/2000 |
| WO | 01/81528 | 11/2001 |
| WO | 02/44310 | 6/2002 |

OTHER PUBLICATIONS

*International Search Report No. PCT/EP 03/02108 dated May 30, 2003, 3 pp.* WPI Acc. # 1999-001386-199901 Derwent abstract of EP 0 881 279 A2.
*UK Search Report No. GB 0207484.7 dated Sep. 30, 2002, 1 page.*
WPI Acc.No. 1990-258558/199034 Abstract of JP 02 182972.
WPI Acc.No. 1995-019866/199503 Abstract of JP 06 306769.
EPO CAPLUS 1995:220749 Abstract of JP 06 228875.
WPI Acc.No. 1987-112239/198716 Abstract of JP 62 057639.
WPI Acc. No. 1996-478742/1996648 Abstract of WP 0 739976.
WPI Acc. No. 1994-110308/199414 Abstract of WO 94/07978.
WPI Acc. No. 2002-590507/200263 Abstract of WO 02/44310.

* cited by examiner

*Primary Examiner*—John R. Hardee
(74) *Attorney, Agent, or Firm*—Ellen Plotkin

(57) ABSTRACT

A quaternary ammonium material of the formula:

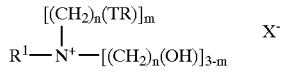

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group,
T is

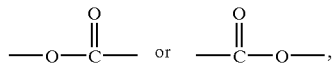

n is 0 or a number selected from 1 to 4, m is 1, 2 or 3 and denotes the number of moieties to which it relates that pend directly from the N atom, and $X^-$ is an anionic group, such as halides or alkyl sulphates, has a mean particle size of from 100 to 1200 $\mu$m. The material is provided in a solid fabric conditioning composition at a level of from 1 to 45 wt % in combination with a carrier material.

4 Claims, No Drawings

SOLID FABRIC CONDITIONING COMPOSITIONS

FIELD OF THE INVENTION

The present invention relates to solid fabric conditioning compositions. More particularly the invention relates to solid fabric conditioning compositions providing good softening characteristics to fabrics and/or having good dispersion characteristics in liquid.

BACKGROUND OF THE INVENTION

Traditionally, fabric conditioning has been carried out either during the rinsing step of a fabric washing and rinsing process or during tumble drying of the fabric. Typically, rinse conditioning is accomplished by adding a liquid dispersion of a rinse conditioning agent to the rinse liquor. The liquid dispersion was traditionally distributed and made available to consumers as a ready to use aqueous dispersion. More recently, concern for the environment and consumer convenience has led to the sale of concentrated aqueous dispersions which are either used in smaller amounts or are mixed with water to form a dilute composition before use.

In EP 234082 it has been proposed to supply rinse conditioner as a solid block. This approach requires the use of a special restraint for the block and may also require the modification of the washing machine to enable the block to be dissolved and dispensed by a spray system.

Various proposals have been made to supply fabric softener in granular or powdered form.

WO-A2-02/44310 relates to a granular conditioning compound. There is no disclosure of the particle size of the cationic softening material.

WO-A1-99/60081 discloses stabilised compositions comprising quaternary ammonium materials. There is no mention of mean particle size of the softening material.

WO-A1-94/07978 describes a process for producing powdered or granular detergent mixtures. No reference is made to particle size.

EP-A1-0739976 discloses textile and hair conditioners comprising esterqauats and fatty acid amides. There is no mention of esterqauats having a specific mean particle size.

JP622875 discloses specific quaternary ammonium materials which show better softening effects than di(hydrogenated tallow alkyl) dimethyl ammonium chloride.

EP 111074 discloses a powdered rinse conditioner based on a silica carrier for the softening agent. A disadvantage of using a carrier such as silica is that it can cause bulking of the product and appears to serve no function beyond making the powder compatible with other ingredients that may be contained in washing powder.

WO 92/18593 describes a granular fabric softening composition comprising a nonionic fabric softener and a single long alkyl chain cationic material. The specification teaches that effective cationic softening compositions when used in granular form exhibit poor dispersion properties and so, despite the obvious environmental and transport saving advantages of selling a water free powdered rinse conditioner, manufacturers have not done so.

EP-B1-0568297 discloses a powdered rinse conditioner comprising a water insoluble cationic active and a nonionic dispersing agent.

It is known that solid fabric conditioners can be formed by combining quaternary ammonium compounds with a water soluble carrier such as urea.

U.S. Pat. No. 5,259,964 (Colgate-Palmolive) discloses a free flowing spray-dried rinse conditioner. U.S. Pat. No. 4,427,558 (Unilever) discloses a method of preparing fabric softening particles comprising a cationic fabric conditioning materials urea and a salt of a fatty acid.

A problem with powdered rinse conditioners Is that they are frequently difficult to disperse in water and thereby subsequent softening of fabrics is detrimentally affected.

Deposition aids have been proposed for depositing clay softeners. For example, WO-A1-00/60039 (Proctor and Gamble) discloses a solid rinse conditioner comprising clay, surfactant, a solid carrier and a flocculating agent which aids deposition of the clay. The preferred flocculating agent is an organic polymer such as polyethylene oxide.

EP-A-0107479 (Unilever) discloses a liquid or granular rinse conditioner comprising a nonionic conditioner (such as sorbitan monostearate) and aluminum chloro-hydrate which acts as a deposition aid for the nonionic conditioner.

EP-A-0267999 (Unilever) discloses a liquid or powder rinse conditioner comprising a non-cationic softener and a nonionic cellulose ether derivative as a deposition aid for the softener.

JP 06306769 (Kao) discloses a solid fabric softener comprising a tertiary amine, a quaternary ammonium salt and urea or a water soluble inorganic salt.

JP 62057639 (Lion) discloses the production of cationic surfactant granules in which a dialkyl quaternary ammonium powder is granulated with an alkali metal chloride or an alkaline earth metal chloride. The chloride is present to improve softness.

JP 02182972 (Kao) discloses a solid softening agent comprising a dialkyl quaternary ammonium salt, a monoalkyl quaternary ammonium salt and urea or a urea derivative. The composition may also contain a water soluble inorganic salt such as sodium chloride, sodium sulphate, magnesium sulphate and potassium nitrate.

Surprisingly, it has now been found that a solid rinse conditioning composition comprising a particular cationic softening agent and a carrier, such as urea, disperses particularly well in liquids. It has also been found that such compositions impart excellent softness to fabrics.

STATEMENT OF INVENTION

Thus, according to the present invention there is provided a solid fabric conditioning composition comprising:

(a) from 1 to 45 wt % by weight of the composition of one or more cationic fabric softening agents; and (b) one or more carrier materials;

wherein the cationic fabric softening agent comprises a quaternary ammonium material of the formula:

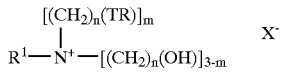

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group, T is

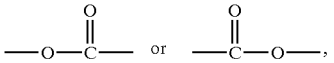

n is 0 or a number selected from 1 to 4, m is 1, 2 or 3 and denotes the number of moieties to which it relates that pend directly from the N atom, and $X^-$ is an anionic group, such as halides or alkyl sulphates, e.g. chloride, methyl sulphate or ethyl sulphate.

DETAILED DESCRIPTION OF THE INVENTION

Cationic Fabric Softening Agent

The cationic fabric softening agent is a quaternary ammonium fabric softening material of the formula:

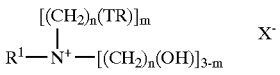

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group, T is

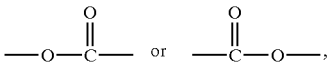

n is 0 or a number selected from 1 to 4, m is 1, 2 or 3 and denotes the number of moieties to which it relates that pend directly from the N atom, and $X^-$ is an anionic group, such as halides or alkyl sulphates, e.g. chloride, methyl sulphate or ethyl sulphate.

Preferably, the level of the mono-ester linked component of the quaternary ammonium material described hereinabove is between 8 and 40% by weight, based on the total weight of the raw material in which the quaternary ammonium material is supplied, more preferably from 12 to 35% by weight, most preferably from 15 to 30% by weight.

Especially preferred materials within this formula are di-alkenyl esters of triethanol ammonium methyl sulphate.

The compositions preferably comprise from 1 to 45% by weight of cationic softening material (active ingredient), based on the total weight of the composition, more preferably 5 to 40% by weight, most preferably 15 to 35% by weight, e.g. 18 to 32% by weight.

Iodine Value of the Parent Fatty Acyl group or Acid

The iodine value of the parent fatty acyl compound or acid from which the cationic softening material is formed is preferably from 0 to 140, preferably from 0 to 100, more preferably from 0 to 60.

It is especially preferred that the iodine value of the parent compound is from 0 to 20, e.g. 0 to 5. Where the iodine value is 5 or less, the cationic softening agent provides excellent softening results on fabrics and has improved resistance to oxidation and associated odour problems upon storage.

In the context of the present invention, iodine value of the parent fatty acyl compound or acid from which the cationic surfactant is formed, is defined as the number of grams of iodine which react with 100 grams of the compound.

One method for calculating the iodine value of a parent fatty acyl compound/acid from which the cationic softening compound is formed, comprises dissolving a prescribed amount (from 0.1–3 g) into about 15 ml chloroform. The dissolved parent fatty acyl compound/fatty acid is then reacted with 25 ml of iodine monochloride in acetic acid solution (0.1 M). To this, 20 ml of 10% potassium iodide solution and about 150 ml deionised water is added. After addition of the halogen has taken place, the excess of iodine monochloride is determined by titration with sodium thiosulphate solution (0.1 M) in the presence of a blue starch indicator powder. At the same time a blank is determined with the same quantity of reagents and under the same conditions. The difference between the volume of sodium thiosulphate used in the blank and that used in the reaction with the parent fatty acyl compound or fatty acid enables the iodine value to be calculated. Other methods for calculating the IV of a parent fatty acyl compound or fatty acid of a softening compound will be apparent to the person skilled in the art.

Excluded Cationic Fabric Softening Agents

Cationic fabric softening compounds not within the scope of the invention are represented by formula (I):

Formula (I)

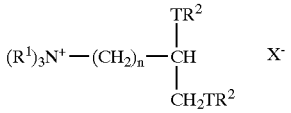

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above; and by formula (II):

(II)

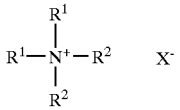

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and $X^-$ is as defined above.

Cationic Softening Agent Raw Material

Preferably the cationic softening material raw material is a solid, more preferably a powder.

Preferably the solid raw material has a mean particle size of from 100 to 1200 μm, more preferably from 200 to 1000 μm, most preferably from 300 to 800 μm, e.g. 400 to 600 μm.

The raw material for use in the compositions of the invention is preferably provided substantially free of solvent, although raw materials provided in a solvent are not excluded from the invention.

Where a quaternary ammonium material is provided in a solvent, it is preferred that the material is treated by evaporating off any solvent and then milling or otherwise grinding the resultant solid to provide a powder of the desired mean particle size.

Carrier Material

The solid composition comprises a carrier material. Preferred carrier materials are those which aid the preparation of a dry, free-flowing powder which disperses readily in water.

Especially preferred carriers are urea-based. The most preferred carrier is urea due to its simplicity and easy availability.

Other suitable carriers include water soluble inorganic salts such as sodium chloride, potassium chloride, magnesium chloride, sodium sulphate, potassium sulphate, magnesium sulphate, sodium carbonate and sodium sesquicarbonate.

The carrier may also comprise a mixture of one or more the aforementioned salts.

The carrier material is preferably present in an amount from 10 to 95% by weight, more preferably 25 to 85% by weight, most preferably 40 to 70% by weight, based on the total weight of the composition.

Deposition Aid

Preferably a deposition aid is present in the compositions of the present invention.

Particularly preferred deposition aids are citric acid or salts of citric acid.

If the deposition aid is a salt of citric acid, it s preferably water soluble. By water soluble, it is meant that the salt has a solubility in excess of 1 gram per liter, preferably is excess of 25 grams per liter.

The counter ion in the salt is preferably an alkaline earth metal, ammonium or alkali metal. Preferably, it comprises an alkali metal cation or ammonium. Typically preferred are sodium, potassium or ammonium salts.

The deposition aid is preferably present in an amount from 0.005% to 20% by weight, more preferably from 0.01% to 10% by weight, most preferably from 0.1% to 5% by weight, based on the total weight of the composition.

Perfume

The compositions of the invention preferably comprise one or more perfumes. Typical perfumes suitable for use in the present invention are disclosed in "Perfume and Flavor Chemicals (Aroma Chemicals)", by Steffen Arctander, published by the author in 1969, the contents of which are incorporated herein by reference.

Preferably the perfume is present in an amount from 0.01 to 10 wt %, more preferably 0.05 to 7 wt %, most preferably 0.1 to 5 wt % based on the total weight of the composition.

A particularly preferred method for incorporating the perfume into the composition is described in U.S. Pat. No. 6,200,949, incorporated by reference herein.

Zeolite

The compositions of the invention preferably comprise a zeolite. Preferred zeolites include alkali metal, preferably sodium, aluminosilicates.

Zeolites may be incorporated in amounts of from 0.1 to 50% by weight (anhydrous basis), preferably from 1 to 30 wt %, based on the total weight of the composition.

The zeolite is present in an amount not greater than 50% by weight, based on the total weight of the composition. The use of less zeolite is important to so as to reduce the problem of poor flow properties, since excess zeolite provides a composition with dust-like particles which are difficult to handle.

The zeolite may be either crystalline or amorphous or mixtures thereof, having the general formula:

$$0.8\text{–}1.5Na_2O.Al_2O_3.0.8\text{–}6SiO_2$$

These materials contain some bound water and should have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as is typical is the art.

Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

A particularly preferred zeolite is zeolite 4 A.

It has been found that the solid compositions of the present invention, which comprise a cationic softener and a carrier, such as urea, have excellent flow properties (typically exhibiting flow rates of 90 ml/s or more, more preferably 100 ml/s or more, most preferably 110 ml/s or more). Without the zeolite present, it has been found that such desirable flow rates are only achieved by a very narrow wt % range of the cationic softener. By incorporating a zeolite into the composition, the excellent flow properties can be achieved over a much broader wt % range of the cationic softener.

In particular, it has been found that the presence of the zeolite enables much higher levels of the cationic softener to be present in the composition without detrimentally affecting the flow properties of the solid.

In use, when the solid composition is added to liquid, e.g. water, the zeolite rapidly disperses to give a milky solution. Although not essential to the invention, this provides a highly desirable attractive appearance to the composition.

Fatty Alcohol

Optionally and advantageously, one or more un-alkoxylated fatty alcohols are present in the composition.

Preferred alcohols have a hydrocarbyl chain length of from 10 to 22 carbon atoms, more preferably 11 to 20 carbon atoms, most preferably 15 to 19 carbon atoms.

The fatty alcohol may be saturated or unsaturated, though saturated fatty alcohols are preferred as these have been found to deliver greater benefits in terms or stability, especially low temperature stability.

Suitable commercially available fatty alcohols include tallow alcohol (available as Hydrenol S3, ex Sidobre Sinnova, and Laurex CS, ex Clariant).

The fatty alcohol content in the compositions is from 0 to 10% by weight, more preferably from 0.005 to 5% by weight, most preferably from 0.01 to 3% by weight, based on the total weight of the composition.

Nonionic Surfactants

It is preferred that the compositions further comprise a nonionic surfactant. Typically these can be included for the purpose of stabilising the compositions.

Suitable nonionic surfactants include addition products of ethylene oxide and/or propylene oxide with fatty alcohols, fatty acids and fatty amines.

Any of the alkoxylated materials of the particular type described hereinafter can be used as the nonionic surfactant.

Suitable surfactants are substantially water soluble surfactants of the general formula:

$$R—Y—(C_2H_4O)_z—C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms.

In the general formula for the ethoxylated nonionic surfactant, Y is typically:

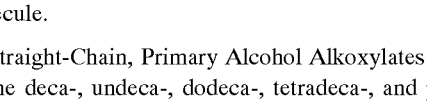

in which R has the meaning given above or can be hydrogen; and Z is at least about 8, preferably least about 10 or 11.

Preferably the nonionic surfactant has an HLB of from about 7 to about 20, more preferably from 10 to 18, e.g. 12 to 16.

Examples of nonionic surfactants follow. In the examples, the integer defines the number of ethoxy (EO) groups in the molecule.

A. Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are $C_{18}$ EO (10); and $C_{18}$ EO (11). The ethoxylates of mixed natural or synthetic alcohols in the "tallow" chain length range are also useful herein. Specific examples of such materials include tallow alcohol-EO (11), tallow alcohol-EO (18), and tallow alcohol-EO (25), coco alcohol-EO (10), coco alcohol-EO (15), coco alcohol-EO (20) and coco alcohol-EO (25).

B. Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful viscosity and/or dispersibility modifiers in the context of this invention.

Exemplary ethoxylated secondary alcohols useful herein as the viscosity and/or dispersibility modifiers of the compositions are: $C_{16}$ EO (11); $C_{20}$ EO (11); and $C_{16}$ EO (14).

C. Alkyl Phenol Alkoxylates

As in the case of the alcohol alkoxylates, the hexa- to octadeca-ethoxylates of alkylated phenols, particularly monohydric alkylphenols, having an HLB within the range recited herein are useful as the viscosity and/or dispersibility modifiers of the instant compositions. The hexa- to octadeca-ethoxylates of p-tri-decylphenol, m-pentadecylphenol, and the like, are useful herein. Exemplary ethoxylated alkylphenols useful as the viscosity and/or dispersibility modifiers of the mixtures herein are: p-tridecylphenol EO (11) and p-pentadecylphenol EO (18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

D. Olefinic Alkoxylates

The alkenyl alcohols, both primary and secondary, and alkenyl phenols corresponding to those disclosed immediately hereinabove can be ethoxylated to an HLB within the range recited herein and used as the viscosity and/or dispersibility modifiers of the instant compositions.

E. Branched Chain Alkoxylates

Branched chain primary and secondary alcohols which are available from the well-known "OXO" process can be ethoxylated and employed as the viscosity and/or dispersibility modifiers of compositions herein.

F. Polyol Based Surfactants

Suitable polyol based surfactants include sucrose esters such sucrose monooleates, alkyl polyglucosides such as stearyl monoglucosides and stearyl triglucoside and alkyl polyglycerols.

The above nonionic surfactants are useful in the present compositions alone or in combination, and the term "nonionic surfactant" encompasses mixed nonionic surface active agents.

The nonionic surfactant is present in an amount from 0.01 to 15%, more preferably 0.1 to 12%, most preferably 0.35 to 10%, e.g. 0.5 to 7% by weight, based on the total weight of the composition.

Flow Aid

A flow aid is optionally present in the compositions of the invention.

The flow aid preferably comprises a fine particulate material which coats the solid, e.g. powder granules, so as to provide excellent storage and handling properties.

Preferred flow aids are the commercially available sodium aluminosilicates, zeolite A, zeolite MAP and Alusil.

Of course, if the flow aid is a zeolite it may also act as a carrier for the cationic softening material.

The flow aid is preferably present in an amount from 0.001% to 10% by weight, more preferably from 0.01% to 5% by weight, most preferably from 0.1% to 2% by weight, based on the total weight of the composition. If the flow aid is a zeolite, higher levels can be present.

The flow aid is typically the final ingredient to be added to the composition once the solid composition is substantially already formed.

Other Optional Ingredients

The compositions may also contain one or more optional ingredients conventionally included in fabric conditioning compositions such as pH buffering agents, perfume carriers, fluorescers, colourants, hydrotropes, antifoaming agents, antiredeposition agents, polyelectrolytes, enzymes, optical brightening agents, anti-shrinking agents, anti-wrinkle agents, anti-spotting agents, germicides, fungicides, anti-corrosion agents, drape imparting agents, anti-static agents, ironing aids, dyes and fatty acids.

Product Form

The compositions of the present invention are solids, such as powders tablets or bars. It is particularly preferred that the solid is a free-flowing powder. Ideally the powder has a mean particle size of less than 1000 microns as this improves the flow and dispersion characteristics of the powder. More preferably the mean particle size is less than 700 microns. Preferably the dynamic flow rate of the powder is greater than 90 ml/s and more preferably greater than 100 ml/s. Preferably the bulk density of the powder is less than 800 g/L.

Product Use

The product is preferably used in the rinse stage of a laundry process. It is envisaged that the product is suitable for use in hand rinsing or machine rinsing operations.

EXAMPLES

The invention will now be illustrated by the following non-limiting examples. Further modifications will be apparent to the person skilled in the art.

Samples of the invention are represented by a number. Comparative samples are represented by a letter.

All values are % by weight of the active ingredient unless stated otherwise.

Suitable methods for preparing the solid compositions are as follows:

In a first method, a carrier (e.g. urea) is mixed with a powdered quaternary ammonium material (the raw material provided as a solid ground to the desired mean particle size). Optional ingredients (such as zeolite and citrate) are added and mixed. Suitable mixers for mixing the ingredients include the Sirman C6 mixer granulator and the Fukae FS30 mixer. Other types of mixers could also be used including drum mixers, ploughshares and fluid bed mixers. If required a binder, such as a nonionic surfactant and/or polyethylene glycol, can be added to improve granulation. Other optional ingredients, such as perfume and dye, are then added separately to the solids. The mixture is then granulated for between 15–30 seconds and an optional flow aid may be added with a further 5 seconds mixing. If the composition is too wet it can be weathered to allow the liquid components to equilibrate within the powder structure, providing a dry free-flowing powder.

In an alternative process, the carrier (e.g. urea) and other solids (such as zeolite and citrate) are added to a mixer and mixed for 10–15 seconds. The quaternary ammonium material is heated until molten and added to the solids in the mixer. Optional formulation aids, such as nonionic surfactant and tallow alcohol, can be co-melted with the quaternary ammonium material. Other optional ingredients, such as perfume and dye, are added separately to the solids. The mixture is then granulated for between 15–30 seconds and an optional flow aid may be added with a further 5 seconds mixing. The composition can be weathered as per the first method above if necessary.

Sample 1 was prepared to the first method above. Sample A was prepared according to the alternative process above.

TABLE 1

| Sample | 1 | A |
|---|---|---|
| Urea (1) | 68.0 | 61.0 |
| Softener (2) | 25.0 (2) | 20.0 (3) |
| Zeolite (4) | 5.0 | 10.0 |
| Perfume | 1.8 | 1.8 |
| CTAC (5) | 0 | 5.0 |
| Citric acid | 0 | 2.0 |
| Dye | 0.2 | 0.2 |

(1) Urea Pure A, ex BASF
(2) Tetranyl AHT-1, ex Kao, where any solvent is removed by evaporation in a fume cupboard, and the solid milled using a Moulinex food mixer to give powder of mean particle size within range 200 to 600 $\mu$m.
(3) Varisoft TA-100, distearyl dimethyl ammonium chloride, ex Goldschmidt
(4) Wessalith P, 80% active in 20% water, ex Crosfield
(5) Cetyl trimethyl ammonium chloride, ex Clariant

Example 1

Softening Evaluation

Softening assessments were carried out as follows:

Each of the rinse product samples were weighed out to an equivalent of 2.6 g/l and placed into a Terg-o-tometer containing 1 liter of water. Three terry towelling monitors (20×20 cm) weighing 40 g were then placed into the Terg-o-tometer pot and rinsed for further 5 minutes. The cloths were removed, spun and then line dried. The monitors were ranked on a softness scale from 1 (denoting soft) to 8 (denoting harsh). The data was analysed using SAS to determine significant differences.

The average scores are given below in table 2.

TABLE 2

| Sample | Softness |
|---|---|
| 1 | 3.7 |
| A | 4.9 |

The invention claimed is:

1. A solid quaternary ammonium raw material, for use in a solid fabric conditioning composition, represented by the formula:

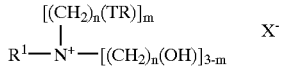

wherein each R is independently selected from a $C_{5-35}$ alkyl or alkenyl group, $R^1$ represents a $C_{1-4}$ alkyl, $C_{1-4}$ alkenyl or a $C_{1-4}$ hydroxyalkyl group, T is

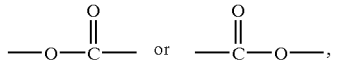

n is 0 or a number selected from 1 to 4, m is 1, 2 or 3 and denotes the number of moieties to which it relates that pend directly from the N atom, and $X^-$ is an anionic group; wherein the mean particle size of the quaternary ammonium material is from 100 to 1200 $\mu$m.

2. The solid quaternary ammonium material as claimed in claim 1, wherein said quaternary ammonium material is used with urea carrier material in said solid fabric conditioning composition.

3. The solid quaternary ammonium material as claimed in claim 1, wherein said anionic group is selected from the group consisting of halides and alkyl sulphates.

4. The solid quaternary ammonium material as claimed in claim 1, wherein said anionic group is selected from the group consisting of chloride, methyl sulphate, and ethyl sulphate.

* * * * *